United States Patent [19]

Koch

[11] Patent Number: 4,681,090

[45] Date of Patent: Jul. 21, 1987

[54] INCUBATOR FOR PREMATURES AND NEWBORNS

[75] Inventor: Joachim Koch, Hollenbek, Fed. Rep. of Germany

[73] Assignee: Drägerwerk Aktiengesellschaft, Lübeck, Fed. Rep. of Germany

[21] Appl. No.: 825,328

[22] Filed: Feb. 3, 1986

[30] Foreign Application Priority Data

Feb. 1, 1985 [DE] Fed. Rep. of Germany ..... 3503418

[51] Int. Cl.[4] ..... A61G 11/00

[52] U.S. Cl. ..... 128/1 B

[58] Field of Search ..... 128/1 B

[56] References Cited

U.S. PATENT DOCUMENTS 3,335,713 8/1967 Grosholz et al. ..... 128/1 B

*Primary Examiner*—Henry J. Recla

*Attorney, Agent, or Firm*—Walter Ottesen

[57] ABSTRACT

An incubator for premature and newborn infants includes a housing defining a first housing portion and a second housing portion. A transparent hood is mounted on the housing so as to define an enclosure with the first housing portion for accommodating the infant therein. Conditioning equipment for conditioning the air in the enclosure is mounted in the second housing portion. An exchangeable support is removably mounted in the first housing portion and is adapted for supporting the infant thereon. The second housing portion is partitioned from the air in the enclosure by means of an insert to permit those components which communicate with the air in the enclosure to be thermally disinfected. The support and the insert are configured as removable individual components resistant to temperatures of a thermal disinfection.

3 Claims, 1 Drawing Figure

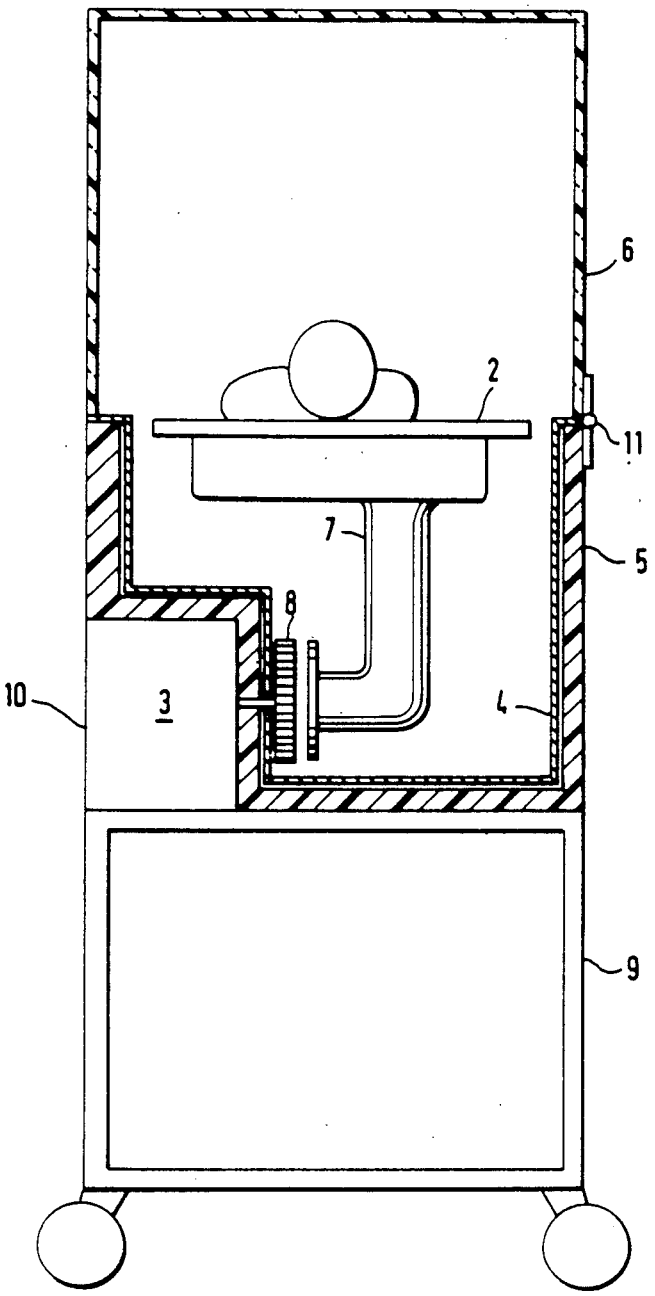
6
2
11
7
5
8
10
3
4
9

INCUBATOR FOR PREMATURES AND NEWBORNS

FIELD OF THE INVENTION

The invention relates to an incubator for prematures and newborns having a support to receive the infant thereon, a transparent hood surrounding the support on all sides, and an apparatus disposed in a part of the housing for conditioning the air inside the incubator.

BACKGROUND OF THE INVENTION

An incubator of the type referred to above is known from Australian patent specification No. 62,950/80.

Incubators of this type are used for maintaining premature and newborn infants in an environment adapted to their needs. This environment is determined by the following factors, among others: temperature, moisture content and oxygen content in the air surrounding the newborns. To this end, the supporting surface for the infant is surrounded by a transparent hood, which is closed on all sides and has closable apertures or openings that are to be used only for performing various medical manipulations. Inside this hood, the ambient air is regulated by a suitable apparatus to the parameter values, such as temperature, humidity and oxygen content, that have been set by the user of the incubator.

Since the climatic conditions in the interior of the hood, where the infant is located, promote germ growth because of the increased humidity that is always present and because of the optimal temperature for growth of approximately 37° C., both interior and exterior surfaces, in the case of the known incubator, must be disinfected after the apparatus has been in use for some time. Chemical disinfection methods are the only recourse here, because not all parts of the incubator can be thermally disinfected, since not all parts, as for example plastic parts, can withstand the temperature of 105° C. and even 134° C. required for thermal disinfection. As a rule, electronic components, which are used in the apparatus for regulating the incubator air, are not capable of withstanding such temperature stresses.

However, chemical disinfectants leave residues for a relatively long period after the disinfection has been performed. If these residues are located on the interior surfaces of the housing, for instance, then they can be given off into the interior air while the incubator is in operation. In that case, however, these residues also come into contact with the surface of the skin of the infant in the incubator, and if the infant is breathing spontaneously they also get into its breathing passages.

The apparatus required for preparing the interior air circulates this air continuously, so that the air supply conduits required for this purpose too may be coated with chemical residues, which are also given off into the interior air during the course of operation of the incubator.

If thermal disinfecting or sterilizing methods are used in incubators, then chemical disinfectants can be dispensed with so that chemical residues will no longer be given off to the interior air.

SUMMARY OF THE INVENTION

Accordingly, it is an object of the invention to improve upon an incubator of the above-mentioned type, such that a disinfection method that is free of chemical residues, for example a thermal disinfection method, can be used, at least for those parts of the incubator that are in contact with the interior air thereof or that for those parts disinfection can be dispensed with entirely.

The incubator of the invention includes a housing part for accommodating the conditioning equipment for conditioning the air in the interior chamber of the incubator. The above object is achieved by providing an insert to isolate the above-mentioned housing part from the air in the enclosure of the incubator and by configuring the support and the insert as removable, interchangeable separate parts.

It is an advantage of the invention that the incubator is divided into one group of interchangeable components which are in contact with the interior air of the incubator, and another group of components which can be disinfected using the conventional chemical disinfection methods, because either they do not communicate with the interior air of the incubator or, as in the case where the cover is of acrylic glass or plexiglass, any adhering residues of disinfectant are negligible.

In this way, the thermal disinfection is limited to those parts which can be placed in conventional disinfecting or sterilizing equipment. Removing and replacing the individual parts can be done quickly, so that the operation of an incubator according to the invention does not have to be interrupted by a protracted, tedious disinfection of the entire incubator inside a closed disinfection chamber. The effort and expense of disinfection can become particularly low because the insert is designed as a thin-walled, inexpensive disposable part.

Given an appropriate structural configuration of the removable insert, the incubator can also be used in an emergency without the insert installed and without any functional impairment whatever.

The support and the insert can advantageously be made of a material that withstands the high temperatures of 105° C. or even 134° C. that prevail during thermal disinfection. As a result, re-use of the thermally disinfected individual parts is possible.

The apparatus for conditioning the interior air in terms of air temperature, moisture content and oxygen content can suitably be provided with a metal insert which contains the air supply ducts. Other components of the apparatus, such as its electronic control unit, are hermetically sealed in the housing part, so that only parts protruding from the housing, such as the heater and the fan wheel, need to be removed before removal of the metal insert; this can be done easily, for instance by using plug connections.

BRIEF DESCRIPTION OF THE DRAWING

The invention will now be described with reference to the drawing which shows an end elevation view, partially in section, of the incubator for prematures and newborns according to the invention.

DESCRIPTION OF THE PREFERRED EMBODIMENTS OF THE INVENTION

In the partially cutaway view of an incubator shown in the drawing, a support 2 configured as a resting surface is located inside a housing part 5 which is attached to a movable carriage 9. The regulating unit 3 required for conditioning the interior air is located in the housing 10 and includes an electric current supply unit, a regulating unit and a motor that drives the fan wheel 8. Located in the housing part 5 underneath the support 2 is a metal insert 4 which includes the ducts 7 that carry the air. The hood 6 is mounted above the support 2 on the periphery of the housing 5. After the cover 6 is opened by swinging it about its hinge 11, the insert 4 can be removed after removal of the support 2 and the fan wheel 8.

It is understood that the foregoing description is that of the preferred embodiment of the invention and that various changes and modifications may be made thereto without departing from the spirit and scope of the invention as defined in the appended claims.

What is claimed is:

1. An incubator for premature and newborn infants comprising:

a base wall and mutually adjacent side walls extending upwardly from said base wall;

a transparent hood mounted on said side walls to conjointly define a compartment with said base wall and said side walls for accommodating the infant therein;

at least a portion of said base wall being configured to define an enclosure outside of said compartment;

conditioning means mounted in said enclosure for conditioning the air supplied to said compartment;

a removable insert liner complimentally configured to the inside surface of said base wall and said side walls and extending over the surface of said walls inside of said compartment so as to separate said walls and said enclosure from the air within said compartment; and, a support for the infant removably mounted in said housing so as to facilitate removal of said insert liner.

2. The incubator of claim 1, said support and said insert liner being made of a material capable of withstanding the temperatures of a thermal disinfection.

3. The incubator of claim 1, said insert liner and said support being made of metal.

* * * * *

UNITED STATES PATENT AND TRADEMARK OFFICE

CERTIFICATE OF CORRECTION

PATENT NO. : 4,681,090

DATED : July 21, 1987

INVENTOR(S) : Jochim Koch

It is certified that error appears in the above-identified patent and that said Letters Patent is hereby corrected as shown below:

On the front page, under Inventors, delete "Joachim Koch" and substitute -- Jochim Koch -- therefor.

Signed and Sealed this

Twenty-sixth Day of January, 1988

*Attest:*

DONALD J. QUIGG

*Attesting Officer*

*Commissioner of Patents and Trademarks*